US005190327A

United States Patent [19]

Lin

[11] Patent Number: 5,190,327

[45] Date of Patent: Mar. 2, 1993

[54] TUBULAR DOOR LOCK

[76] Inventor: Jui C. Lin, No. 55-10 Been Chou Rd., Kangshan, Kaohsiung Hsien, Taiwan

[21] Appl. No.: 910,431

[22] Filed: Jul. 8, 1992

[51] Int. Cl.[5] ..... E05B 3/00

[52] U.S. Cl. ..... 292/348; 292/357

[58] Field of Search ..... 70/216; 292/348, 357, 292/169.23, DIG. 38, DIG. 64, 356

[56] References Cited

U.S. PATENT DOCUMENTS 3,471,190 10/1969 Wansbrough et al. ..... 292/348 X
3,716,261 2/1973 Gerlach ..... 292/357
4,588,221 5/1986 Miller et al. ..... 292/348
4,784,418 11/1988 Pearson et al. ..... 292/348

*Primary Examiner*—Richard E. Moore
*Attorney, Agent, or Firm*—Jacobson, Price, Holman & Stern

[57] ABSTRACT

A tubular door lock for low safety comprising two knobs provided with a tubular shaft combined with a bearing plate, the tubular shaft having a hook and a projection to combine with an actuating plate, a square rod provided to fit in the actuating plates at both ends to enable the two knobs—the inner and the outer one—to move together at the same time.

5 Claims, 4 Drawing Sheets

TUBULAR DOOR LOCK

BACKGROUND OF THE INVENTION

Tubular door locks generally have different functions and safety standards according to their uses. For example, one used in a door to enter a house should have high safety against burglary, but ones used in a door of a bathroom, a toilet or a bedroom etc. in a house do not need high safe locking structure. Nevertheless, they are always made of metal, to a resultant high cost in manufacture. A U.S. patent application Ser. No. 07/735,263, filed Jul. 24, 1991, now U.S. Pat. No. 5,157,952, issued Oct. 27, 1992 and titled "Tubular Door Lock" by this same applicant offered a kind of structure, wherein locking the lock by an inner knob is accomplished by first pressing and subsequent rotating of said knob, and unlocking by said knob can be done only by rotating of said knob.

SUMMARY OF THE INVENTION

The object of this invention is to provide a tubular door lock having low safety structure to be used in a door not needing high safety against burglary such as ones for a bathroom, a toilet, bedroom, etc. in a house, and very low cost in manufacture by using plastics instead of metal as material for the knobs and tubular shafts.

BRIEF DESCRIPTION OF THE DRAWINGS

This invention will now be described in detail with reference to accompanying drawings wherein.

DETAILED DESCRIPTION OF THE INVENTION

Figure 1:
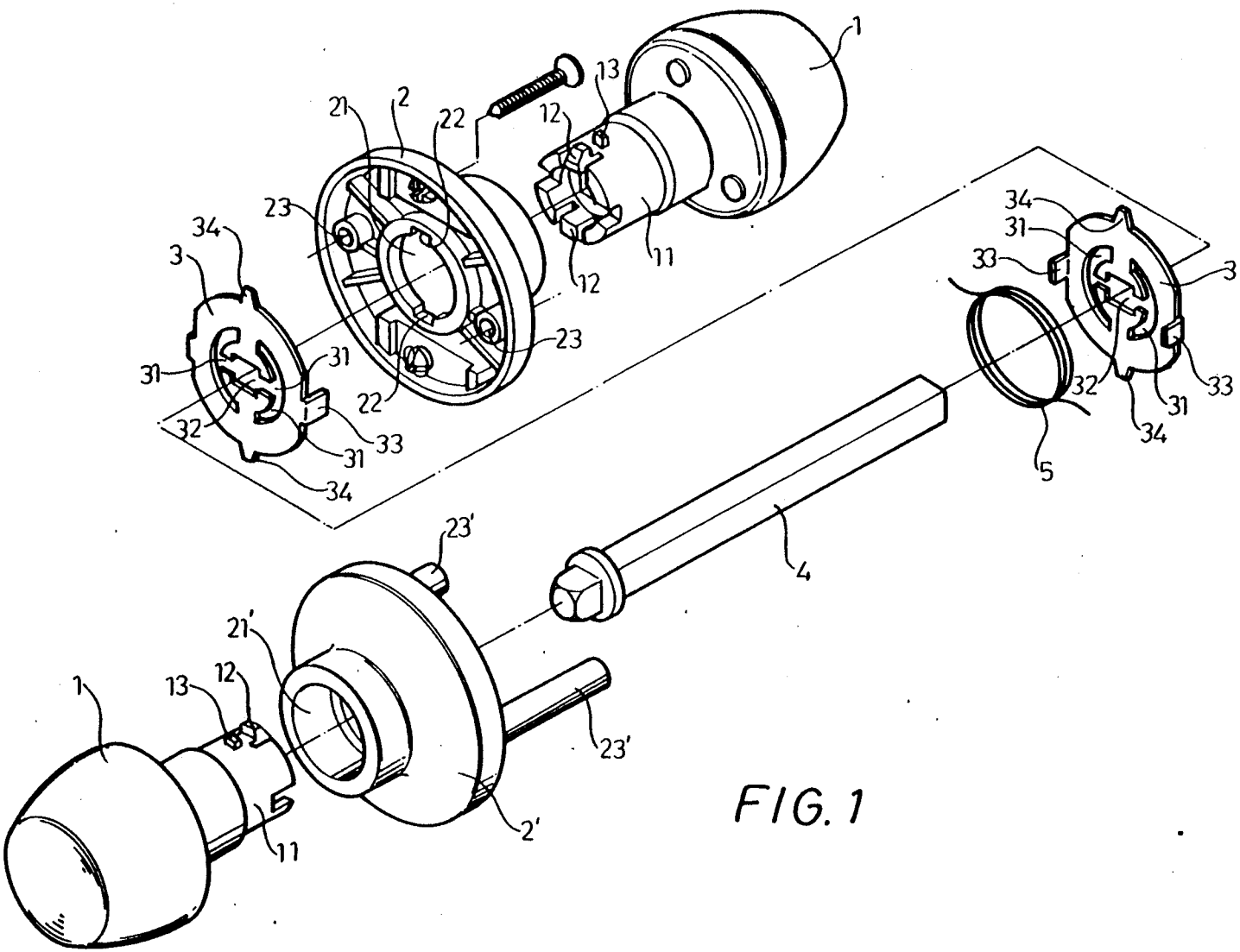
FIG. 1 is an exploded perspective view of a first embodiment of a tubular door lock in the present invention.
Figure 3:
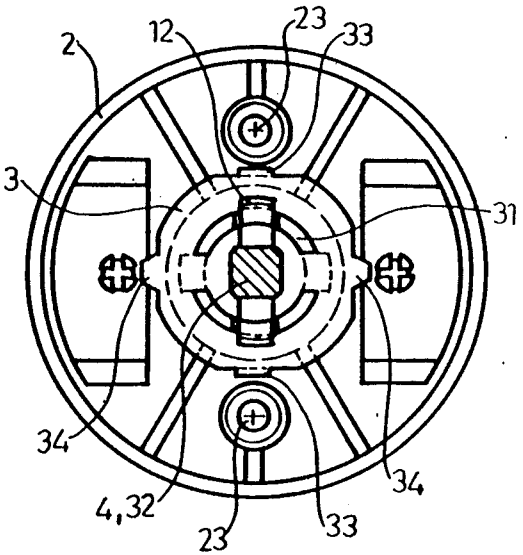
FIG. 3 is a cross-sectional view taken along line 3—3 of FIG. 2.

The tubular door lock in the present invention, as shown in FIG. 1, has no function of locking a door, i.e. only keeping a door closed, comprising two knobs 1, two bearing plates 2, 2', an actuating plate 3, and a square shaft 4 as main components.

Figure 2:
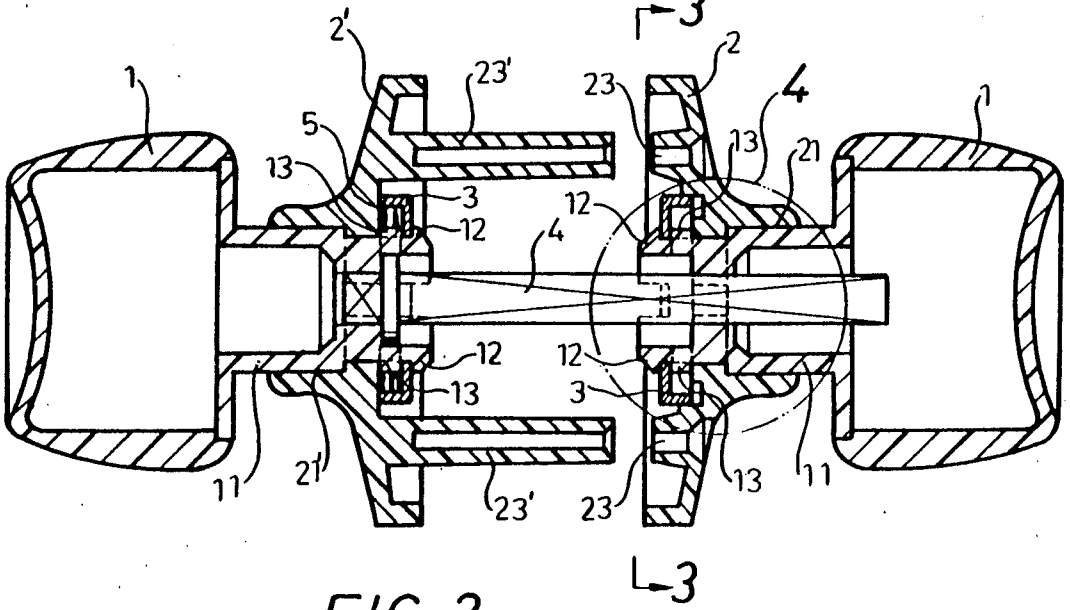
FIG. 2 is a front cross-sectional view of the first embodiment of a tubular door lock in the present invention.

The knobs 1, as shown in FIGS. 1 and 2, are made of plastics and fused together by means of high frequency treatment, having a tubular shaft 11 for the square shaft 4 to extend therein, two opposite hooks 12 and two opposite projections 13 on an outer surface of the tubular shaft 11, two slots at both sides of each hook 12 so as to give the hook 12 good resilience to move up and down, a space between each hook 12 and each projection 13 for the actuating plate 3 to fit therein to combine the actuating plate 2 with the knob 1.

Figure 4:
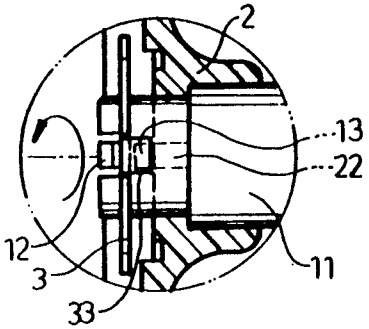
FIG. 4 is a non-cross-sectional view of the portion marked 4 in FIG. 2.

The bearing plates 2, 2' are made of plastics, having a shaft hole 21 in the center for the tubular shaft 11 to fit in, two opposite notches 22 in a circumferential edge of the shaft hole 21 for the projections 13 to pass therethrough so as to let the knob 1 rotate 90 degrees for engaging the actuating plate 3 as shown in FIG. 4. The bearing plates 2, 2' are respectively assembled with the outside and the inside of a door, having two holes 23 or two locating tubes 23' for screws to pass through the holes 23 and screw with the locating tubes 23' to combine both the bearing plates 2, 2' firmly together.

The actuating plates 3 respectively have two opposite crescent slots 31 for the tubular shaft 11 to extend through, a straight slot 32 communicating with the two slots 31, a square hole formed in the middle portion of the slot 32 for the square shaft to insert therein to make both the actuating plates 3 and the square shaft 4 move each other, two opposite feet 33 for a foot of a spring 5 to hook thereon, and two stop projections 34 to contact with the locating tubes 23' to stop the bearing plates 34 in rotating.

The square shaft 4 passes through a latch to move it to open or close a door provided with this tubular lock, has both ends each going through the straight slot 32 in the actuating plates 3 so as to let the outer and the inner knob move together at the same time.

Figure 5:
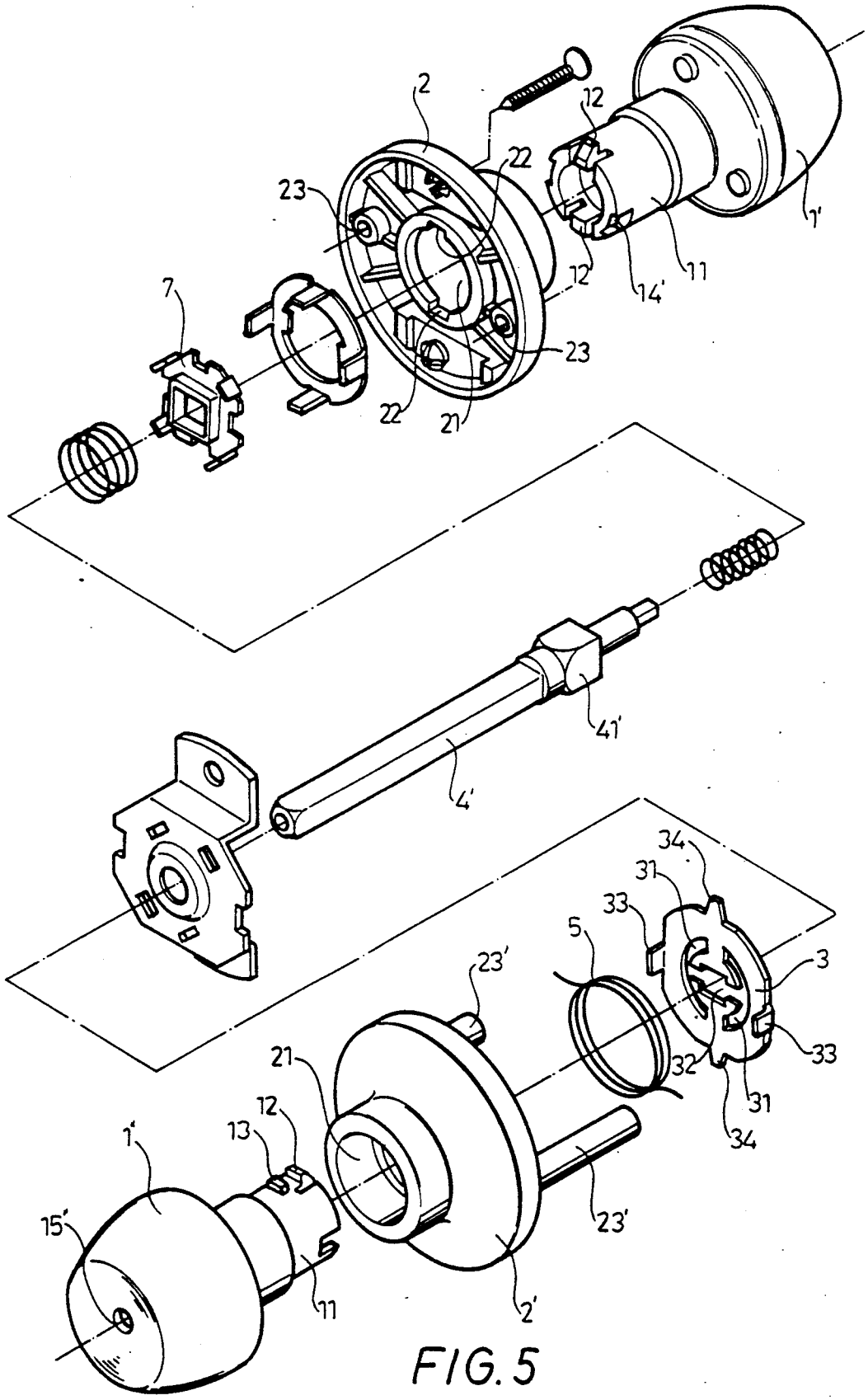
FIG. 5 is an exploded perspective view of a second embodiment of a tubular door lock in the present invention.

A second embodiment in the present invention has knobs the same as that used in the U.S. patent application Ser. No. 07/735,263, as shown in FIG. 5, provided with a locking structure possible to be locked only at the inside of a door for a bathroom, a toilet, etc. by changing the structure slightly by means of a different part.

Figure 6:
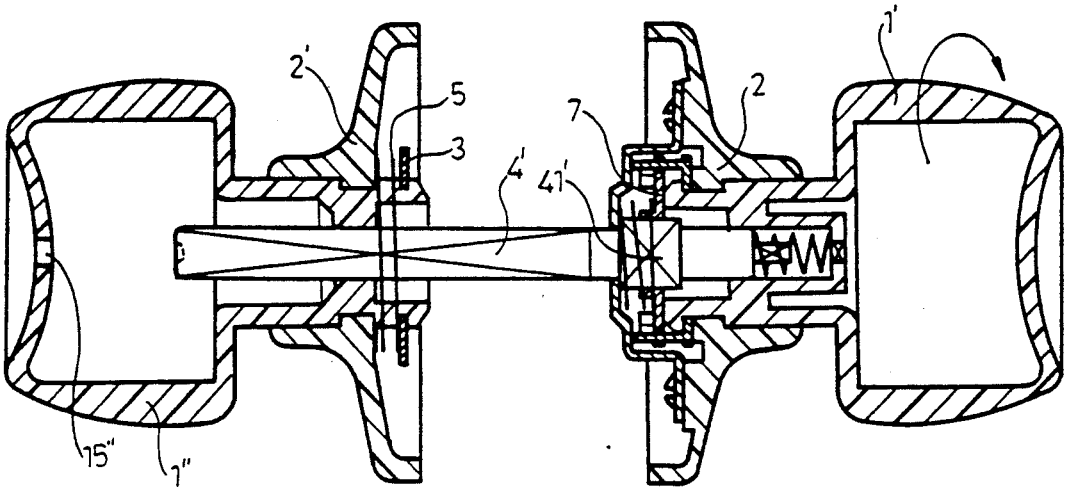
FIG. 6 is a front cross-sectional view of the tubular door lock in the present invention.
Figure 7:
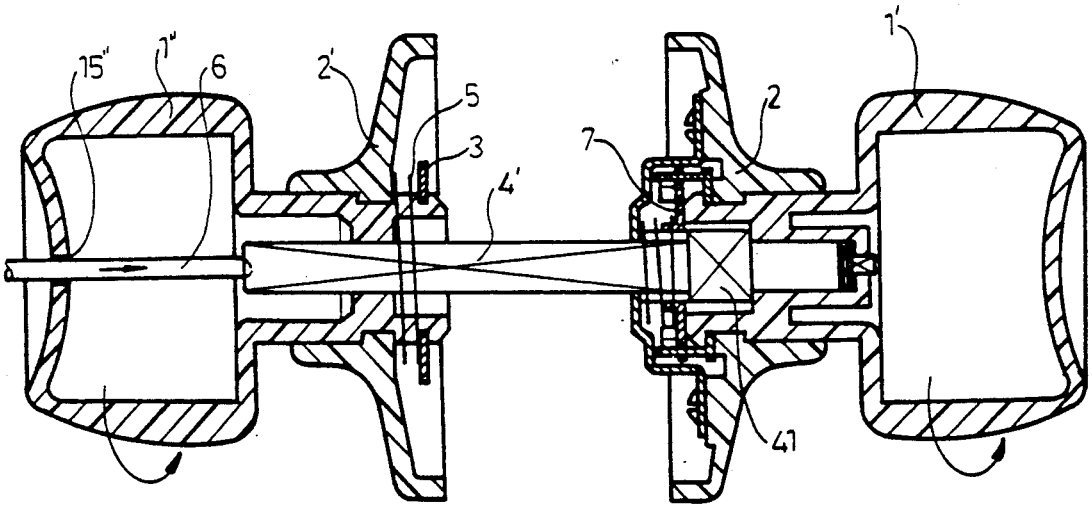
FIG. 7 is a front cross-sectional view of the tubular door lock being operated in the present invention.

The inner knob 1' in the second embodiment is only a little altered from that in the first embodiment additionally being provided with an L-shaped notch 14' in the tubular shaft 11, getting rid of the projections 13 of the first embodiment, and the outer knob 1'' is additionally provided with a central hole 15' for a bar 6 to insert therein. Then as FIG. 6 shows, the inner knob 1' can be locked by pressing and rotating, and as FIG. 7 shows, the bar 6 can be inserted through the hole 15 of the outer knob 1'' to press the stop projection 41' in the square shaft 4' to force it disengage from a stop projection 7 to open the door in emergency.

What is claimed is:

1. A tubular door.lock comprising two knobs, the inner and the outer one, which respectively have a tubular shaft, each said tubular shaft passing through a shaft hole in a bearing plate and having a projecting hook and a projection on a circumferential surface thereof, each said bearing plate having two opposite notches in the circumference of the shaft hole for the projections of the each tubular shaft to pass through so as to combine the knob with an actuating plate, said two actuating plates respectively having two opposite crescent slots for the tubular shaft of the knob to fit therein, a straight slot communicating with said two crescent slots for the hook of the tubular shaft to pass through to let the actuating plate laterally fit in a space between the hook and the projection of the tubular shaft, and a square shaft having both ends fitting in the straight slot in both the actuating plates so that the square shaft and said two actuating plates can move each other.

2. The tubular door lock as claimed in claim 1, wherein said straight slot in said actuating plates has a square hole in its intermediate portion for the square shaft to fit therein for mutual movement.

3. The tubular door lock as claimed in claim 1, wherein said tubular shaft of said inner knob is provided with an L-shaped notch to enable the inner knob to rotate in relation to a stop plate.

4. The tubular door lock as claimed in claim 1, wherein said knobs and said tubular shafts are made of plastics and fused together by means of high frequency or other treatment.

5. The tubular door lock as claimed in claim 1, wherein said bearing plates are made of plastics, having a shaft hole and two opposite notches in the circumference of the shaft hole for the tubular shaft of a knob to pass through said shaft hole.

* * * * *